United States Patent [19]

Nishida et al.

[11] 4,331,899

[45] May 25, 1982

[54] SPARK PLUG

[75] Inventors: Minoru Nishida; Tadashi Hattori; Akira Tanaka, all of Okazaki, Japan

[73] Assignee: Nippon Soken, Inc., Nishio, Japan

[21] Appl. No.: 123,819

[22] Filed: Feb. 22, 1980

[30] Foreign Application Priority Data

Mar. 9, 1979 [JP] Japan ..... 54-28002
Mar. 15, 1979 [JP] Japan ..... 54-30803

[51] Int. Cl.[3] ..... H01T 13/32

[52] U.S. Cl. ..... 313/141; 313/139; 313/142

[58] Field of Search ..... 313/139–142; 123/169 EL

[56] References Cited

U.S. PATENT DOCUMENTS 1,537,586 5/1925 Champion ..... 313/142

4,109,633 8/1978 Mitsudo et al. ..... 313/141 X

*Primary Examiner*—Eugene La Roche

*Attorney, Agent, or Firm*—Cushman, Darby & Cushman

[57] ABSTRACT

A spark plug comprises a center electrode fixed to a leg portion which is exposed into the combustion chamber of an engine and comprises a ground electrode which is bent so that its end opposes the forward end of the center electrode whereby discharge is produced between the ground electrode and the center electrode. The ground electrode includes a discharging surface not opposing a first side end portion of the center electrode which is near the bent portion, but opposing a second side end portion of the center electrode which is remote from the bent portion of the ground electrode. The discharging surface of the ground electrode may be provided by forming a projection or groove at the opposing end of the ground electrode.

7 Claims, 42 Drawing Figures

FIG. 9A1
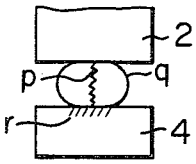
FIG. 9B1
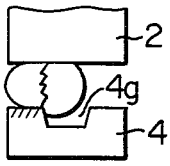
FIG. 9C1
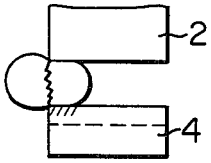
FIG. 9D1
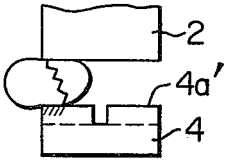
FIG. 9A2
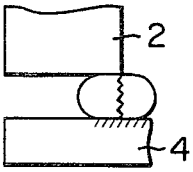
FIG. 9B2
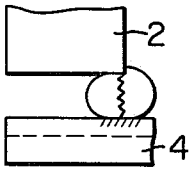
FIG. 9C2
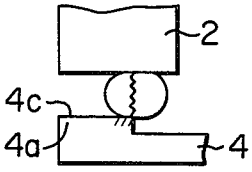
FIG. 9D2
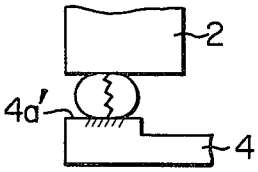
FIG. 9A3
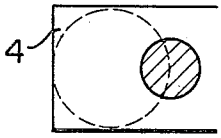
FIG. 9B3
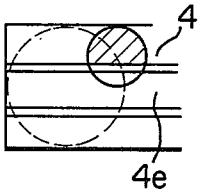
FIG. 9C3
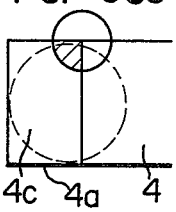
FIG. 9D3
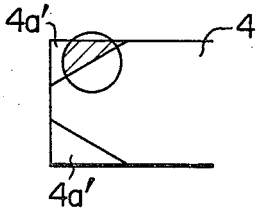
FIG. 11A
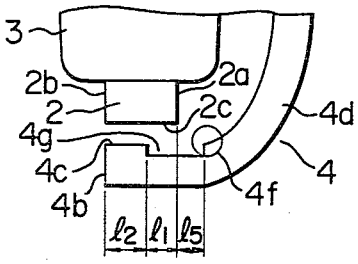
FIG. 12A
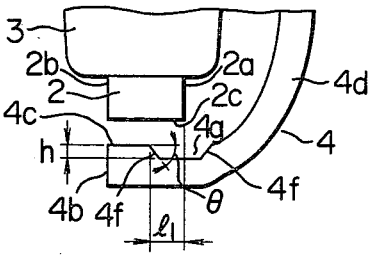
FIG. 11B
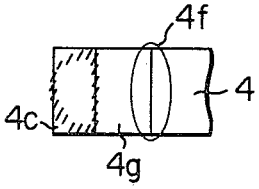
FIG. 12B
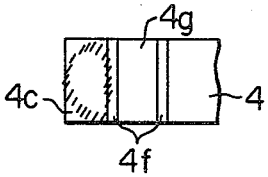

SPARK PLUG

FIELD OF THE INVENTION

This invention relates to spark plugs adapted for use in automotive vehicles or the like, and more particularly the invention relates to an improved spark plug in which the discharge path is controlled so as to ensure an improved ignition performance.

SUMMARY OF THE INVENTION

It is the object of the invention to provide a spark plug in which the ground electrode is shaped differently from that of the prior art plugs so as to control the location of discharge and thereby to improve the ignition performance on the whole and reduce variation in the manner of flame propagation or variation in the combustion due to the location of discharge.

BRIEF DESCRIPTION OF THE DRAWINGS

FIGS. 10A and 10B to FIGS. 16A and 16B are respectively a partial enlarged view and a model diagram showing the location of discharge for still another embodiments of the spark plug according to the invention.

DESCRIPTION OF THE PRIOR ART

Figure 1A:
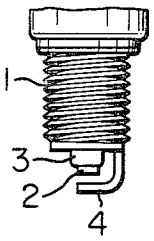
FIG. 1A PRIOR ART
FIG. 1A is a side view showing a principal part of a prior art spark plug.
Figure 1B:
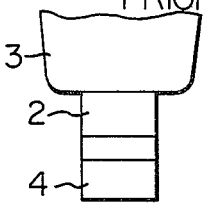
FIG. 1B PRIOR ART
FIG. 1B is a left side view of the principal part of the spark plug of FIG. 1A.

A type of spark plug known in the prior art is shown in FIGS. 1A and 1B. In the Figures, the known spark plug comprises a metal plug shell or body 1, an insulator 3 secured to the plug shell 1 by means of a packing which is not shown, a center electrode 2 enclosed by the insulator 3 and insulated from the plug shell 1, and a ground electrode 4 fixedly secured to the end of the plug shell 1 so as to be grounded through the plug body, and the center electrode 2 and the ground electrode 4 have their parallel plane surfaces arranged to oppose each other and thereby to provide a spark gap.

Figure 2:
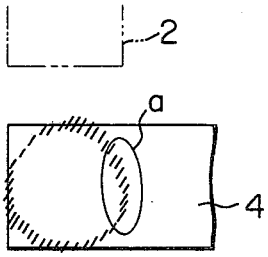
FIG. 2 is a model diagram showing the location of discharge at the ground electrode in the spark plug of FIG. 1.

With the thus constructed prior art spark plug, when the high voltage generated by the known ignition coil of the current interruption type is applied to the center electrode 2 so as to produce a discharge, the discharge tends to start at the edge portion of the center electrode 2 and consequently the path for the discharge to develop and travel tends to be directed from the edge portion (the side) of the center electrode 2 toward the ground electrode 4 or its hatched portion as shown in FIG. 2. In addition, the hatched location of discharge irregulary change each time. As a result, the manner in which the air-fuel mixture is ignited and the resulting flame spreads varies in dependence on the path of discharge.

Figure 3A:
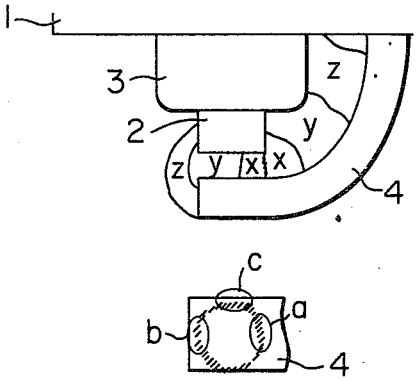
FIGS. 3A to 3D are model diagrams showing the manner of development of a flame core depending on different discharge paths of the spark plug shown in FIG. 1.
Figure 3B:
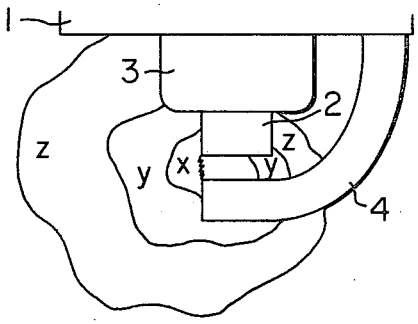
Figure 3C:
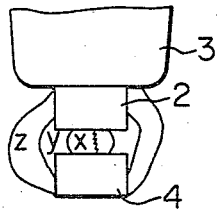
Figure 3D:
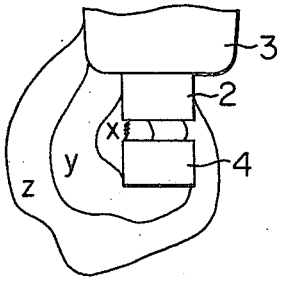

FIGS. 3A to 3D show the results of the photographed observations on the manner of flame spread according to different paths of discharge. In the Figures, symbols x, y and z show the respective flame fronts at intervals of a fixed time from the time of the ignition. FIG. 3A shows the case in which the discharge path is directed toward the backward part of the ground electrode 4 or the hatched portion a in FIG. 3A, so that the flame spreads along the ground electrode 4 which prevents the spreading of the flame and also absorbs the heat of the flame and consequently the growth of the flame is slow. On the contrary, in FIG. 3B the discharge path is directed to the front side of the ground electrode 4 or the hatched portion b of FIG. 3A, so that since there is no obstacle to the left side of the discharge, the flame tends to spread easily and the rate of combustion in the engine is extremely high as compared with the case of FIG. 3A. Referring to FIGS. 3C and 3D showing left side views of FIG. 3A, in FIG. 3C the discharge path is the same hatched portion a as in FIG. 3A and in FIG. 3D the discharge path is the hatched portion c of FIG. 3A causing the discharge at the end of the ground electrode 4. It will be apparent that in the case of FIG. 3D the flame spreads faster than in the other cases. While the combustion takes place in any of these experimental cases, under unfavorable conditions, such as, at low engine temperatures, low engine speeds, retarded ignition timing or the like where the mixture is not atomized satisfactorily and the flow velocity of the mixture is low, even if the mixture is ignited, the flame will be extinguished midway due to the obstruction and cooling by the ground electrode 4.

Thus, in the case of the known spark plug, the manner in which the flame spreads varies in dependence on the location of discharge and this results in variation of the combustion. In addition, under unfavorable engine conditions the engine will cause misfire and also deteriorated engine feeling and heat-melting loss of the exhaust emission controlling catalyst will be caused.

Figure 4A:
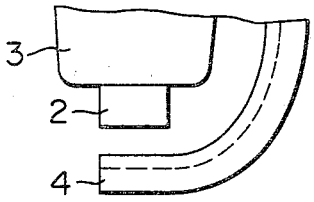
FIG. 4A PRIOR ART
FIGS. 4A and 4B are respectively a front view and side view showing a principal part of another prior art spark plug.
Figure 4B:
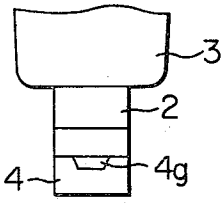
FIG. 4B PRIOR ART
Figure 5:
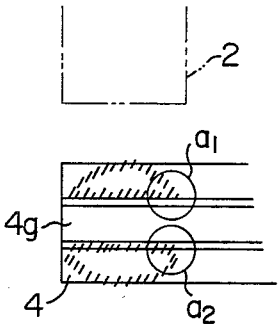
FIG. 5 is a model diagram showing the locations of discharge at the ground electrode in the prior art spark plug shown in FIG. 4.

On the other hand, another type of spark plug is known in the art in which the ground electrode 4 is formed with a U-shaped groove **4*g* in the lengthwise direction as shown in FIGS. 4A and 4B. The provision of the groove 4*g* in the ground electrode 4 reduces the contact area between the ground electrode 4 and the flame core ignited by the discharge, so that while the cooling effect is reduced with the resulting improvement in the ignition performance, the location of discharge becomes the hatched portions of FIG. 5 and if the discharge takes place at these hatched portions $a_1$ and $a_2$, the resulting improvement in the ignition performance of the spark plug on the whole will not be quite satisfactory due to the cooling effect in the lengthwise direction of the ground electrode 4**.

On the other hand, another method is conceivable in which the opposing portions of the ground and center electrodes are formed into needle shape so as to reduce the cooling effect of the electrode as far as possible. However, this method is disadvantageous in that the electrodes will be consumed with the lapse of the engine operation time so that the discharge gap will be widened with the resulting increase in the dielectric breakdown voltage and eventually the discharge will no longer be produced.

In accordance with the present invention there is thus provided an improved spark plug which overcomes the foregoing deficiencies of the prior art spark plugs and ensures more reliable and stable ignition performance and discharge function. The invention will now be described in detail with reference to the illustrated embodiments.

DESCRIPTION OF THE PREFERRED EMBODIMENTS

Figure 6:
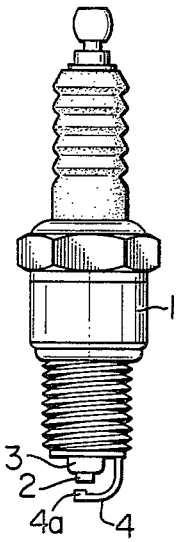
FIG. 6 is a general view of a spark plug according to an embodiment of the invention.
Figure 7A:
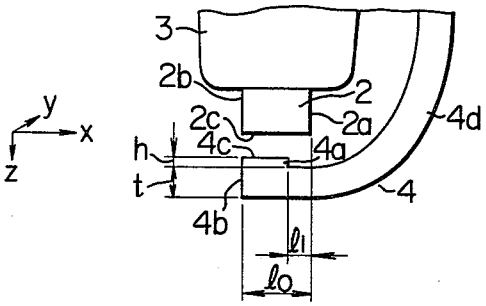
FIG. 7A is an enlarged view showing a principal part of the embodiment shown in FIG. 6.
Figure 7B:
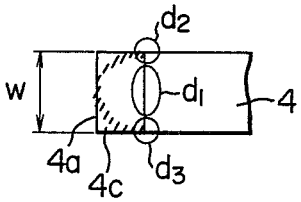
FIG. 7B is a model diagram showing the location of discharge in the plug of FIG. 7A.

FIG. 6 is a general view showing an embodiment of the present invention. In the Figure, a spark plug according to the invention comprises a metal plug body or shell 1, a center electrode 2, an insulator 3 for insulating the center electrode 2 from the plug shell 1 and a ground electrode 4 fixed to the plug shell 1 and body grounded through the plug shell 1. Referring to FIGS. 7A and 7B illustrating enlarged views of the spark discharge section in the spark plug of the invention shown in FIG. 6, the ground electrode 4 includes an integral projection 4*a* formed on the forward end thereof as shown in the illustration. The projection 4*a* is positioned on the side of an end face 4*b* from a side face 2*a* of the center electrode 2 by a distance $l_1$ which is shorter than a distance $l_0$ from the end face 4*b* of the ground electrode 4 to the side face 2*a* which is adjacent to a bend 4*d* of the ground electrode 4, and the projection 4*a* extends over the entire width of the ground electrode 4*a* in a direction normal to the lengthwise direction thereof.

The end face 4*b* of the ground electrode 4 is substantially on the perpendicular from the side face 2*b* of the center electrode 2. As a result, in the present embodiment, a discharging face 4*c* of the ground electrode 4 opposing a discharging face or end face 2*c* of the center electrode 2 forms the top face of the projection 4*a* and it is smaller than that of the known spark plug shown in FIG. 1B.

In this embodiment the location of discharge is indicated by the hatching in FIG. 7B. In this case, if the distance $l_1$ in FIG. 7A is excessively small, there is the possibility of causing a discharge from the edge portion of the side face 2*a* of the center electrode 2 to a portion $d_1$ shown in FIG. 7B. On the contrary, if the distance $l_1$ is excessively large, the discharging face 4*c* of the ground electrode 4 will be reduced in size giving rise to an inconvenience from the standpoint of electrode consumption. Thus the distance $l_1$ must be selected so as to meet these two requirements. In this case, it is desirable that the distance $l_1$ is greater than one third of the diameter of the center electrode 2, that is, if the diameter of the center electrode 2 is about 2.4 mm and the width w of the ground electrode 4 is 2.4 mm, it is necessary to select the distance $l_1$ to come within the range of 0.8 to 1.4 mm. The height h of the projection 4*a* must be sufficiently large so that even if the discharging faces are consumed due to the discharge and combustion, no discharge will take place on the perpendicular of the side face 2*a* of the center electrode 2. For instance, the height h must be selected 0.5 mm or over. While the diameter of the center electrode 2 is selected about 2.4 mm in the above-mentioned case, it may be selected from the range of 1 to 3.2 mm depending on the intended application, and the distance $l_1$, the projection height h and the width w of the ground electrode 4 should only be selected in correspondence with the diameter of the center electrode 2. The thickness t of the ground electrode 4 must be selected from about 1 to 2 mm. As regards the method of forming the projection 4*a* of the ground electrode 4, any one of various cutting machine tools may be employed to provide the required projection with ease. The suitable materials for the ground electrode 4 include all the materials having good heat resisting and corrosion resisting properties, such as nickel alloys. Also the projection 4*a* of the ground electrode 4 and the other end portions may be rounded more or less.

Figure 8B:
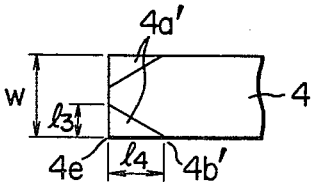
FIG. 8B is a plan view of the ground electrode of the plug shown in FIG. 8A.
Figure 8A:
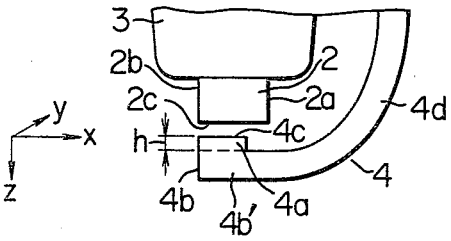
FIG. 8A is a partial enlarged view showing another embodiment of the spark plug of the invention shown in FIG. 6.
Figure 8C:
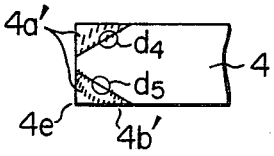
FIG. 8C is a model diagram showing the locations of discharge at the ground electrode of FIG. 8B. FIGS. $9A_1$, $9A_2$ and $9A_3$, $9B_1$, $9B_2$ and $9B_3$, $9C_1$, $9C_2$ and $9C_3$, and $9D_1$, $9D_2$ and $9D_3$ are model diagrams showing, as looked from the directions x, y and z in FIG. 7A or 8A, the discharge path and the flame core condition for the prior art spark plug of FIG. 1, the other prior art spark plug of FIG. 2, the spark plug of the invention shown in FIG. 7 and the spark plug of the invention shown in FIG. 8, respectively.

Referring now to FIGS. 8A to 8C, there is illustrated a general view showing another embodiment of the invention. In the Figures, the spark plug of this embodiment comprises a metal plug body or shell 1, a center electrode 2, an insulator 3 for insulating the center electrode 2 from the plug shell, and a J-shaped ground electrode 4 fixed to the plug shell 2 and body grounded by way of the plug shell 1. FIG. 8A is an enlarged front view of the principal part of the spark plug according to this embodiment, and FIG. 8B is a plan view of the ground electrode 4 as looked from the above. As shown in FIGS. 8A and 8B, the shape of the ground electrode 4 is such that one side of an end portion 4*b*′ of the ground electrode 4 which opposes an end face or discharging face 2*c* of the center electrode 2 is formed at each corner 4*e* with a triangular projection 4*a*′ having two sides of lengths $l_3$ and $l_4$. The projections 4*a*′ are provided so as to not oppose a side end face portion (on the "2*a*" side) of the face 2*c* of the center electrode 2 which faces a bend 4*d* of the ground electrode 4. An end face 4*b* of the ground electrode 4 is positioned on the perpendicular of a side face 2*b* of the center electrode 2. The projections 4*a*′ formed on the ground electrode 4 form a discharging face 4*c*. In this embodiment the location of discharge becomes as shown by the hatching in FIG. 8*c*. In this case, the discharging surface decreases with a decrease in the lenghts $l_3$ and $l_4$ in FIG. 8B and the cooling effect of the ground electrode 4 is also decreased with the resulting improvement in the ignition performance. On the contrary, if the lengths $l_3$ and $l_4$ are increased, the discharging surface will be increased and the location of discharge will also increase toward the center and the lengthwise direction of the ground electrode 4 with the resulting increase in the cooling effect. Thus it is necessary to select the length $l_3$ and $l_4$ so that the location of discharge does not become the position a of FIG. 2. For example, if the diameter of the center electrode 2 is about 2.4 mm and the width w of the ground electrode 4 is also 2.4 mm, it is necessary to select so that $l_3 = 1.0$ mm and $l_4 = 1.5$ mm or $l_3 = 0.6$ mm and $l_4 = 3.0$ mm. On the other hand, the height h of the projections 4a' must be selected so that even if the electrodes are consumed due to the discharge and combustion, no discharge is allowed to occur on the perpendicular of the side face 2a of the center electrode 2. It is only necessary to select the height h 0.3 mm or over. Further, while the diameter of the center electrode 2 is selected about 2.4 mm in the above-mentioned case, it may be selected within the range of 1 to 3.2 mm depending on the intended application and the values of $l_3$, $l_4$, h and w should also be selected in correspondence with the diameter of the center electrode 2. The ground electrode 4 may be made of any one of materials having good heat resisting and corrosion resisting properties, such as nickel alloys. The projections 4a' of the ground electrode 4 as well as the other end portions may be rounded to some extent.

The function of the spark plug constructed as shown in FIGS. 7 and 8 will now be described. When a high voltage is applied to the center electrode 2, the insulation is broken down and discharge is caused. In this case, while the path for the discharge is dependent on the electric field distribution between the electrodes 2 and 4, the shape of the electrodes 2 and 4, the surface roughness of the electrodes 2 and 4, etc., the discharge generally tends to occur at the electrode edges and in the case of the spark plugs shown in FIGS. 7 and 8 the discharge occurs at the hatched portion in FIGS. 7B and 8C, respectively. To make a comparison between the spark plugs in terms of ignition performance, the comparison must be made under the worst conditions. Thus, the extent to which the flame was cooled by the ground electrode was studied by means of the photographs of the prior art spark plug of FIG. 1 discharging at the portion a of FIG. 2, the prior art spark plug of FIG. 4 discharging at the portion $a_1$ or $a_2$ of FIG. 5, the spark plug of the invention of FIG. 7 discharging at the portion $d_2$ or $d_3$ in FIG. 7B and the spark plug of the invention of FIG. 8 discharging at the portion $d_4$ or $d_5$ in FIG. 8c. The results are photographed and shown in FIG. 9. In the Figure, FIGS. $9A_1$, $9A_2$ and $9A_3$, $9B_1$, $9B_2$ and $9B_3$, $9C_1$, $9C_2$ and $9C_3$, and $9D_1$, $9D_2$ and $9D_3$, respectively corresponding to the prior art plug of FIG. 1, the prior art plug of FIG. 4, the plug of the invention shown in FIG. 7 and the plug of the invention shown in FIG. 8, are model diagrams which are respectively looked from the directions x (left side), y (front side) and z (upper side) shown in FIG. 7A. In the diagrams, symbol p designates the discharge path, circle q the flame core and hatching r the surface of the ground electrode 4 which contacts and absorbs the heat of the flame core. As will be seen from FIG. 9, the area of the hatched portion in the plug of the invention shown in FIGS. 7 and 8, respectively, is very small as compared with those of the prior art plug of FIG. 1 and the U-grooved prior art plug of FIG. 4, and also the spark plugs of the invention shown in FIGS. 7 and 8 are reduced greatly in the cooling effect of the ground electrode 4.

Another embodiments of the invention which are modifications of the embodiment of FIG. 7, will now be described with reference to FIGS. 10 to 13.

Figure 10A:
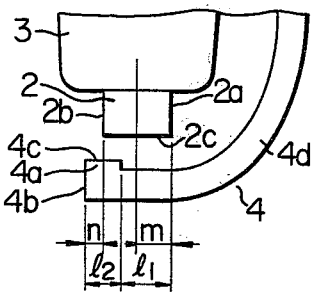
Figure 10B:
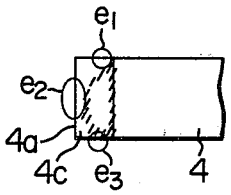

FIGS. 10A and 10B show an embodiment in which the distance $l_1$ shown in FIG. 7A is increased. While it can be said that greater the distance $l_1$, smaller the cooling effect of the ground electrode 4 and more satisfactory from the standpoint of ignition performance, the increased distance $l_1$ results in the reduced area of the discharging surface and this is not desirable from the durability point of view. As a result, the end face 4b of the ground electrode 4 is displaced from the side face 2b of the center electrode 2 by a distance n as shown in FIG. 10A, thus ensuring a lengthwise direction distance $l_2$ of the projection 4a forming the discharging face 4c of the ground electrode 4. In this embodiment the discharge location is shown by the hatching in FIG. 10B. In the Figures, symbols $e_1$, $e_2$ and $e_3$ indicate the locations of discharge corresponding to the cases where the length of the distance n is short in FIG. 10A. In this embodiment, with the diameter of the center electrode 2 being selected about 2.4 mm, if it is selected so that $l_1=m=1.2$ mm, then $l_2=1.2+n$. If it is desired to obtain $l_2=2$ mm, then the distance n becomes $n=0.8$ mm.

FIGS. 11A and 11B show another embodiment in which instead of vertically providing a projection from the upper surface of the ground electrode which forms the discharging face 4c of the ground electrode 4, a groove 4g is formed in the ground electrode 4 in a direction normal to the lengthwise direction thereof so as to extend to both sides of the perpendicular of the side face 2a of the center electrode 2. In this case, a distance $l_5$ extending from the side face 2a of the center electrode 2 to a right side face 4f of the ground electrode 4 is made so large that no discharge occurs at the side face 4f of the groove 4g. The distance $l_5$ should preferably be greater than 1.5 mm. The discharge location of this embodiment is shown by the hatching in FIG. 11B.

FIGS. 12A and 12B show another embodiment of the invention which differs from the embodiment of FIG. 11 in that the side face 4f of the groove 4g is inclined to form an angle $\theta$ with the discharging surface. The angle $\theta$ may be made large when the depth h is small, while it may be made small when the depth h is large, and usually the angle $\theta$ should only be selected within the range of about 30 to 90 degrees. The discharging location of this embodiment is shown in FIG. 12B.

It is to be noted here that the projection 4a of FIG. 7A may be inclined.

Figure 13A:
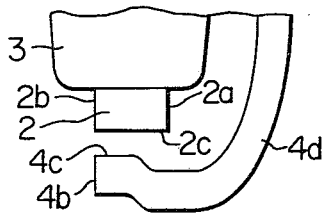
Figure 13B:
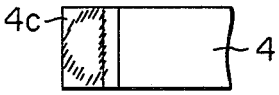

FIGS. 13A and 13B show another embodiment of the invention in which the discharging face 4c is formed by bending the forward end of the ground electrode 4 and this has the effect of simplifying the manufacture.

Figure 14A:
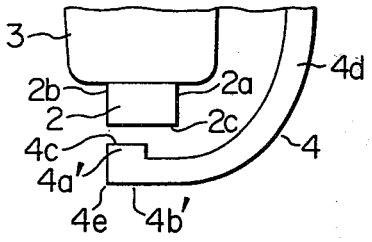
Figure 14B:
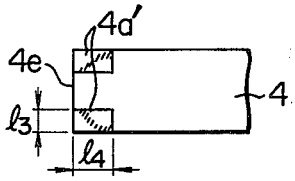

FIGS. 14A and 14B show another embodiment which is a modification of the embodiment shown in FIG. 8 and the projections 4a' of the ground electrode 4 are formed into square shape. The discharging location becomes as shown in FIG. 14B and consequently no discharge occurs at the portion a of FIG. 2. Consequently, in the like manner as the embodiment of FIG. 8, the cooling effect of the ground electrode 4 on the flame core is reduced and the ignition performance is improved. In this case, the length $l_3$ of the discharging surface of the projections 4a' must be shorter than the diameter of the center electrode 2 from the consumption standpoint of the ground electrode 4 and the other length $l_4$ must also be shorter than the same diameter to prevent the location of discharge from becoming the position shown at a in FIG. 2. For instance, if the diameter of the center electrode 2 is 2.4 mm and the width w of the ground electrode 4 is also 2.4 mm, it is necessary to select so that the length $l_3$ is in the range of about 0.5 to 0.8 mm and the length $l_4$ is in the range of about 1.0 to 1.6 mm.

Figure 15A:
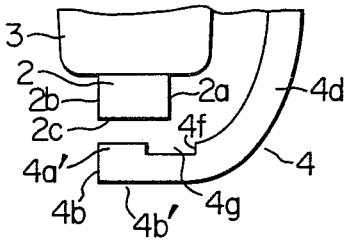
Figure 15B:
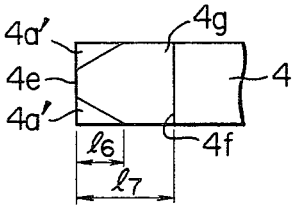

FIGS. 15A and 15B show another embodiment of the invention which differs from the previously mentioned embodiments in that the discharging surface of the ground electrode 4 is provided by cutting the electrode surface other than the discharging surface so as to provide the groove 4g and thereby to provide the triangular projections 4a'. In this case, a length $l_7$ from the end face 4b to the side face 4f of the ground electrode 4 must be selected large so that the discharge is not directed from the side face 2a of the center electrode 2 toward the side face 4f of the ground electrode 4 other than the discharging surface shown in FIG. 15.

Figure 16A:
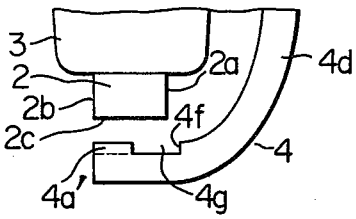
Figure 16B:
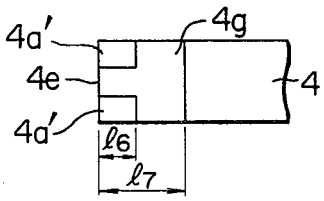

FIGS. 16A and 16B show still another embodiment of the invention in which the groove 4g is cut in the electrode surface other than the discharging surface to form the square projections 4a'. The distance $l_7$ must be made sufficiently large as in the case of FIG. 15.

While, in the embodiments described above, the portion including the projections 4a' made right angles with the ground electrode 4, the projections 4a' may be inclined to some degree. In addition, the edges of the projections 4a' may be rounded to some degree.

Further, while, in the above-described embodiments, the end portion 4b' of the ground electrode 4 comprises the right angle corners 4e, it is possible to suitably round the corners 4e so as to reduce the cooling effect and thereby to further improve the ignition performance.

It will thus be seen from the foregoing description that in accordance with the invention, by virtue of the fact that the forward end of a ground electrode is formed with projection means in such a manner that the projection means does not face the side of a center electrode which faces the bend of the ground electrode, there is a very great advantage that discharge is prevented from occurring at the lengthwise inner part of the ground electrode with the result that the loss of the flame core due to the cooling effect of the ground electrode is reduced and the detrimental effect of the ground electrode on the flame propagation is reduced as far as possible, thereby improving the ignition performance and reducing variation in the combustion.

Further, since the above-mentioned effects can be attained by virtue of improving the shape of a ground electrode, the invention has a very great advantage from the cost point of view over the known methods of improving the ignition performance by improvement on the ignition source or the engine body.

What is claimed is:

1. A spark plug comprising:

a metal plug shell;

an insulator fixed to an inner side of said plug shell;

a center electrode fixed to a leg portion of said insulator exposed into a combustion chamber of an engine; and a ground electrode fixed to said plug shell and including a bent portion such that a forward end of said ground electrode opposes a forward end face of said center electrode whereby an electric discharge may be produced between said center electrode and said ground electrode;

wherein the end face of said center electrode has a first side face portion near said bent portion and a second side face portion remote from said bent portion, and wherein said ground electrode forward end is formed with projection means including a ground electrode discharging surface opposing said second side face portion of said center electrode but not opposing said first side face portion.

2. A spark plug according to claim 1, wherein said projection means forms the ground electrode discharging surface having a rectangular shape, and wherein said rectangular discharging surface is arranged to extend across said ground electrode forward end and is transversely separated from said center electrode first side face portion by a predetermined distance.

3. A spark plug according to claim 2, wherein said rectangular discharging surface extends from said second side face portion in a direction away from said center electrode.

4. A spark plug according to claim 1, wherein said projection means includes a pair of triangular discharging surfaces formed on opposite corner portions of said ground electrode forward end.

5. A spark plug according to claim 1, wherein said projection means includes a pair of rectangular discharging surfaces formed on opposite corner portions of said ground electrode forward end.

6. A spark plug according to claim 1, 4 or 5, wherein said ground electrode is formed, in a portion thereof opposing said first side face portion of said center electrode, with a groove extended in a direction normal to a lengthwise direction of said ground electrode, and wherein said discharging surface or surfaces are defined by said groove.

7. A spark plug according to claim 1, wherein the forward end of said ground electrode is bent, and wherein said discharging surface is formed by said bent forward end portion.

* * * * *